United States Patent [19]

Oda et al.

[11] Patent Number: 4,533,453

[45] Date of Patent: Aug. 6, 1985

[54] ION EXCHANGE MEMBRANE ELECTROLYTIC CELL

[75] Inventors: Yoshio Oda; Takeshi Morimoto; Kohji Suzuki, all of Yokohama, Japan

[73] Assignee: Asahi Glass Company Ltd., Tokyo, Japan

[21] Appl. No.: 355,313

[22] Filed: Mar. 5, 1982

Related U.S. Application Data

[63] Continuation-in-part of Ser. No. 205,567, Nov. 10, 1980.

[30] Foreign Application Priority Data

Mar. 24, 1981 [JP] Japan ..... 56-41789

[51] Int. Cl.[3] ..... C25B 9/00; C25B 11/06; C25B 13/08

[52] U.S. Cl. ..... 204/252; 204/266; 204/283; 204/290 R; 204/296

[58] Field of Search ..... 204/252, 257–258, 204/263–266, 282–283, 296, 290 R, 290 F

[56] References Cited

U.S. PATENT DOCUMENTS

| | | | |
|---|---|---|---|
| 4,210,512 | 7/1980 | Lawrence et al. | 204/257 |
| 4,250,013 | 2/1981 | Carlin | 204/282 |
| 4,272,337 | 6/1981 | Darlington | 204/257 X |
| 4,293,394 | 10/1981 | Darlington et al. | 204/266 X |
| 4,343,689 | 8/1982 | de Nora et al. | 204/283 X |
| 4,394,229 | 7/1983 | Korach | 204/283 |
| 4,457,822 | 7/1984 | Asano et al. | 204/292 X |

FOREIGN PATENT DOCUMENTS 53-11199 7/1976 Japan .

*Primary Examiner*—Donald R. Valentine
*Attorney, Agent, or Firm*—Oblon, Fisher, Spivak, McClelland & Maier

[57] ABSTRACT

An ion exchange membrane electrolytic cell comprises an anode, a cathode, an anode compartment and a cathode compartment partitioned by an ion exchange membrane. A gas and liquid permeable porous non-electrode layer composed of non-oxide ceramics particles is bonded to at least one side of the ion exchange membrane. With use of such a membrane, the cell voltage can considerably reduced in the electrolysis of water, an alkali metal halide, an alkali metal carbonate, etc.

13 Claims, 4 Drawing Figures

ION EXCHANGE MEMBRANE ELECTROLYTIC CELL

CROSS-REFERENCE TO RELATED APPLICATION

This application is a continuation-in-part of Application Ser. No. 205,567, filed Nov. 10, 1980.

BACKGROUND OF THE INVENTION

1. Field of the Invention

The present invention relates to an ion exchange membrane electrolytic cell. More particularly, it relates to an ion exchange membrane electrolytic cell suitable for an electrolysis of water or an aqueous solution of an acid, a base, an alkali metal sulfate, an alkali metal carbonate, or an alkali metal halide and to an ion exchange membrane for the electrolytic cell.

2. Description of the Prior Art

As a process for producing an alkali metal hydroxide by an electrolysis of an aqueous solution of an alkali metal chloride, a diaphragm method has been mainly employed instead of a mercury method in view of a prevention of a public pollution.

It has been proposed to use an ion exchange membrane in place of asbestos as a diaphragm to produce an alkali metal hydroxide by electrolyzing an aqueous solution of an alkali metal chloride so as to obtain an alkali metal hydroxide having high purity and high concentration.

On the other hand, it has been proposed to save energy in the world. From the viewpoint, it has been required to minimize a cell voltage in such technology.

It has been proposed to reduce a cell voltage by improvements in the materials, compositions and configurations of an anode and a cathode and compositions of an ion exchange membrane and a kind of ion exchange group.

It has been proposed to attain an electrolysis by a so-called solid polymer electrolyte type electrolysis of an alkali metal chloride wherein a cation exchange membrane of a fluorinated polymer is bonded with gas-liquid permeable catalytic anode on one surface and a gas-liquid permeable catalytic cathode on the other surface of the membrane (British Pat. No. 2,009,795, U.S. Pat. Nos. 4,210,501 and 4,214,958 and 4,217,401).

This electrolytic method is remarkably advantageous as an electrolysis at a lower cell voltage because an electric resistance caused by an electrolyte and an electric resistance caused by bubbles of hydrogen gas and chlorine gas generated in the electrolysis, can be remarkably decreased which have been considered to be difficult to reduce in the conventional electrolysis.

The anode and the cathode in this electrolytic cell are bonded on the surface of the ion exchange membrane to be embedded partially. The gas and the electrolyte solution are readily permeated so as to easily remove, from the electrode, the gas formed by the electrolysis at the electrode layer contacting with the membrane. Such porous electrode is usually made of a thin porous layer which is formed by uniformly mixing particles which act as an anode or a cathode with a binder, further graphite or the other electric conductive material. However, it has been found that when an electrolytic cell having the electrode bonded directly to an ion exchange membrane is used, the anode in the electrolytic cell is brought into contact with hydroxyl ion which is reversely diffused from the cathode compartment, and accordingly, both of chlorine resistance and an alkaline resistance for anode material are required and an expensive material must be used. When the electrode layer is bonded to the ion exchange membrane, a gas is formed by the electrode reaction between an electrode and membrane and certain deformation phenomenon of the ion exchange membrane is caused to deteriorate the characteristics of the membrane. It is difficult to work for a long time in stable. In such electrolytic cell, the current collector for electric supply to the electrode layer bonded to the ion exchange membrane should closely contact with the electrode layer. When a firm contact is not obtained, the cell voltage may be increased. The cell structure for securely contacting the current collector with the electrode layer is disadvantageously complicated.

The inventors have studied to operate an electrolysis of an aqueous solution at a minimized load voltage and have found that the purpose has been satisfactorily attained by using a cation exchange membrane having a gas and liquid permeable porous non-electrode layer on at least one of surfaces of the cation exchange membrane facing to an anode or a cathode which is proposed in European Patent Publication No. 0029751 or U.S. Ser. No. 205567.

The effect for reducing a cell voltage by the use of the cation exchange membrane having such porous layer on the surface is depending upon a kind of the material, a porosity and a thickness of the porous layer. Thus, it is surprising phenomenon that the effect for reducing a cell voltage is attained even by the use of the porous layer made of a non-conductive material. The effect for reducing a cell voltage is also attained even though electrodes are placed with a gap from the membrane without contacting the electrode to the membrane, although the extent of the effect is not remarkable.

SUMMARY OF THE INVENTION

It is an object of the present invention to provide an electrolytic cell with the reduction of the cell voltage as much as possible.

It is another object of the present invention to provide an electrolytic cell with the low and stable cell voltage for long period.

It is another object of the present invention to reduce a content of particles used for a gas and liquid permeable porous nonelectrode layer bonded on at least one surface of a cation exchange membrane.

The present inventor has conducted a research with an aim to carry out the electrolysis of an aqueous solution to attain these objects, and it has unexpectedly been found that the above objects can satisfactorily be accomplished by using a cation exchange membrane having a gas and liquid permeable porous non-electrode layer composed of non-oxide ceramics particles having no or little electroconductivity, on at least one side thereof facing either the anode or the cathode.

Thus, the present invention provides an ion exchange membrane electrolytic cell comprising an anode, a cathode, an anode compartment and a cathode compartment partitioned by an ion exchange membrane, wherein a gas and liquid permeable porous non-electrode layer composed of non-oxide ceramics particles is bonded to at least one of the surfaces of the ion exchange membrane.

DETAILED DESCRIPTION OF THE PREFERRED EMBODIMENTS:

The extent of cell voltage-reduction obtainable by the use of the cation exchange membrane having such a porous layer on its surface, varies depending upon the kind of the ceramics particles constituting the porous layer and the porosity and thickness of the porous layer. However, it is a quite unexpected phenomenon that such voltage-reduction is obtainable when the porous layer on the surface of the membrane is formed by ceramics particles which have no or extremely small conductivity, as will be described hereinafter, and which are therefore incapable of functioning as an electrode. Further, when the ion exchange membrane having such a porous layer is used, it is preferred that the electrodes are disposed in contact with the membrane. When the electrodes are, however, disposed with a space from the membrane, it is still possible to reduce the cell voltage.

Figure 1:
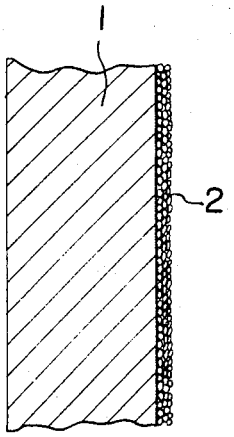
FIG. 1 is an enlarged cross sectional view of a part of an embodiment of the cation exchange membrane of the present invention.
Figure 2:
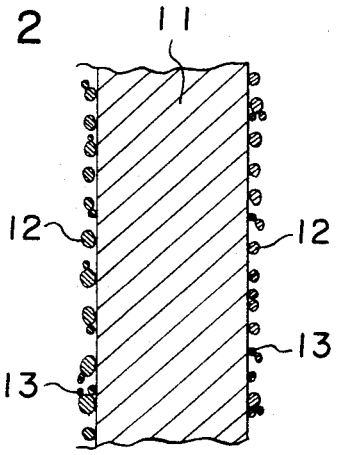
FIG. 2 is an enlarged cross sectional view of a part of another embodiment of the cation exchange membrane of the present invention.

FIG. 1 is a cross sectional view of a part of an embodiment of the cation exchange membrane according to the present invention, and FIG. 2 is a cross sectional view of a part of another embodiment of the present invention. FIG. 1 illustrates a case where a densed porous layer is formed on the surface of the membrane with the non-oxide ceramics particles, in which the surface of the ion exchange membrane 1 is densely covered with a great number of particles 2. Whereas, FIG. 2 illustrates a case where a low density porous layer is formed with the ceramic particles. In this case, particles 12 or groups of particles 13 are bonded to the surface of the membrane partially or wholly discontinuously.

The amount of the ceramics particles to be bonded on the surface of the membrane to form the porous layer, may vary depending on the shape and size of the particles. However, from the study made by the present inventor, it has been found that the amount is preferably within a range of 0.001 to 50 mg/cm$^2$, more preferably 0.005 to 10 mg/cm$^2$. If the amount is excessively small, the desired voltage-saving will not be obtained. On the other hand, if the amount is excessively large, it is likely that the cell voltage will thereby be increased.

As described above, the particles constituting the gas and liquid permeable porous layer on the surface of the cation exchange membrane of the present invention, are composed of non-oxide ceramics particles. Such ceramics particles usually have little electroconductivity and they are extremely hard and have high corrosion resistance and heat resistance. If such particles are used to form a porous layer on the surface of the ion exchange membrane, each particle always maintains its original shape and a porous layer thereby formed, always has constant physical properties. Accordingly, an ion exchange membrane having superior properties is thereby obtainable.

The non-oxide ceramics particles to be used in the present invention are preferably a carbide, a nitride, a silicide, a boride or a sulfide. Any compound selected from carbides, nitrides, silicides, borides and sulfides may be used in the present invention, so long as it is ceramics. For instance, as the carbide, there may be mentioned HfC, TaC, ZrC, SiC, $B_4C$, WC, TiC, CrC, UC or BeC. The nitride may be, for instance, BN, $Si_3N_4$, TiN or AlN. The silicide may be, for instance, a silicide of Cr, Mo, W, Ti, Nb or La. The boride may be, for instance, a boride of Ti, Zr, Hf, Ce, Mo, W, Ta, Nb or La. As the sulfide, there may be mentioned, for instance, $Fe_3S_4$ or $MoS_2$. Among them, $\alpha$-SiC, $\beta$-SiC, $B_4C$, BN, $Si_3N_4$, TiN, AlN, $MoSi_2$ and $LaB_6$ are particularly preferred.

These non-oxide ceramics particles are used in the form of powder preferably having a particle size of 0.01 to 300$\mu$, particularly 0.1 to 100$\mu$. The formation of a porous layer by bonding such particles to the surface of the membrane is carried out preferably in the following manner.

Namely, the ceramics particles to form the porous layer are formed into a dispersion thereof or a syrup or paste containing them with use of a suitable assisting agent or medium as the case requires. In such a form, they are applied to the surface of the membrane. In the preparation of the dispersion or the syrup or paste containing such particles, a fluorinated polymer such as polytetrafluoroethylene may be incorporated as a binder, if necessary.

If desirable, it is possible to use a viscosity controlling agent. Suitable viscosity controlling agents include water soluble materials such as cellulose derivatives such as carboxymethyl cellulose, methylcellulose and hydroxyethyl cellulose; and polyethyleneglycol, polyvinyl alcohol, polyvinyl pyrrolidone, sodium polyacrylate, polyvinyl ether, casein or polyacrylamide. Such a binder or viscosity controlling agent is used preferably in an amount of 0 to 50% by weight, particularly 0.5 to 30% by weight, based on the powder of the ceramic particles.

Further, if necessary, a suitable surface active agent such as a long chain hydrocarbon or a fluorinated hydrocarbon may be incorporated to facilitate the formation of the dispersion, sprup or paste.

The porous layer composed of the non-oxide ceramics particles can be formed on the ion exchange membrane, for instance, by a method which comprises adequately mixing the ceramics particles, if necessary, together with the binder, and the viscosity controlling agent in a suitable medium such as an alcohol, ketone or hydrocarbon to form a paste of the mixture and transferring or printing the paste on the membrane. According to the present invention, it is also possible that instead of the paste of the mixture, a syrup or slurry of polymer particles is directly sprayed on the membrane to deposit the particles to the surface of the ion exchange membrane.

The porous layer of particles or groups of particles formed on the ion exchange membrane is preferably heat pressed on the membrane by a press or a roll at 80° to 220° C. under a pressure of 1 to 150 kg/cm$^2$ (or kg/cm), to bond the layer to the membrane preferably until the particles or groups of particles are partially embedded into the surface of the membrane. The resulting porous non-electrode layer bonded to the membrane has preferably a porosity of 30 to 99% especially 40 to 95% and a thickness of 0.01 to 200μ especially 0.1 to 100μ, which is less than that of the membrane.

Figure 3:
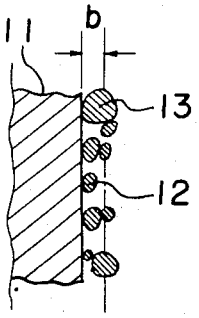
FIGS. 3 (*i*) and 3 (*ii*) are enlarged cross sectional views of parts of the membranes illustrating the porous layers formed by sparsely depositing particles onto the surfaces of the respective membranes.
Figure 3I:
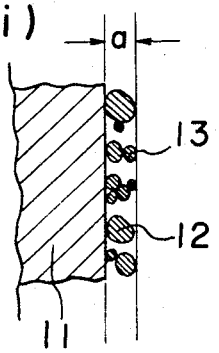

Further, in a case where the porous layer is formed by depositing the ceramics particles sparsely on the membrane as shown in FIG. 2, the thickness of the porous layer is calculated as follows. Namely, if each particle or group of particles has the same height (a) to form a uniform thickness from the surface of the membrane as shown in FIG. 3 (*i*), the value (a) is taken as the thickness of the layer. Whereas, in a case where each particle or group of particles has a different height to form a non-uniform thickness from the surface of the membrane as shown in FIG. 3 (*ii*), an average value (b) is taken as the thickness of the layer. Accordingly, the porosity of the porous layer is a porosity calculated on the basis of such a thickness of the porous layer.

In the present invention, the porous layer composed of the non-oxide ceramic particles, is preferably provided on the cathode side of the ion exchange membrane. In this case, the high and stable voltage saving can be attained for long time since the non-oxide ceramic particle is extremely hard and high corrosion resistance to the catholyte and hydrogen gas. In the case where the layer composed of the non-oxide ceramics particles is provided on the cathode side of the membrane, a gas and liquid permeable porous non-electrode layer composed of metal or metal oxide particles preferably bonded on the anode side of the ion exchange membrane. In this case, the metal is preferably a metal belonging to Group IV-A (preferably germanium, tin or lead), Group IV-B (preferably titanium, zirconium or hafnium), Group V-B (preferably niobium or tantalum) of the Periodic Table, or an iron group metal (preferably iron, cobalt or nickel).

The method for forming the gas and liquid permeable porous layer of metal or metal oxide particles onthe membrane may be the same as the above-mentioned method used for the formation of the porous layer of the non-oxide ceramics particles. Further, the porous layer is likewise required to have the same physical properties as required for the porous layer of the non-oxide ceramics particles.

In the present invention, the ion exchange membrane on which a porous layer is formed, is preferably a membrane of a fluorine-containing polymer having cation exchange groups. Such a membrane is preferably made of a copolymer of a vinyl monomer such as tetrafluoroethylene or chlorotrifluorethylene with a fluorovinyl monomer containing ion exchange groups such as sulfonic acid groups, carboxylic acid groups and phosphoric acid groups.

The ion exchange membrane is preferably made of a fluorinated polymer having the following units $$\text{(M)}\ \left(CF_2-CXX'\right)\ \text{(M mole \%)}$$

$$\text{(N)}\ \left(CF_2-\underset{\underset{Y-A}{|}}{CX}\right)\ \text{(N mole \%)}$$

wherein X represents fluorine, chlorine or hydrogen atom or—$CF_3$; X' represents X or $CF_3CH_2)_m$; m represents an integer of 1 to 5.

The typical examples of Y have the structures bonding A to a fluorocarbon group such as $$\left(CF_2\right)_x,\ -O\left(CF_2\right)_x,\ \left(O-CF_2-\underset{\underset{Z}{|}}{CF}\right)_y,$$

$$-CF_2\left(O-CF_2-\underset{\underset{Z}{|}}{CF}\right)_y,\ \left(O-CF_2-\underset{\underset{Z}{|}}{CF}\right)_x\left(O-CF_2-\underset{\underset{Rf}{|}}{CF}\right)_y \text{ and}$$

$$-O-CF_2\left(\underset{\underset{Z}{|}}{CF}-O-CF_2\right)_x\left(CF_2\right)_y\left(CF_2-O-\underset{\underset{Rf}{|}}{CF}\right)_z$$

x, y and z respectively represent an integer of 1 to 10; Z and Rf represent —F or a $C_1$–$C_{10}$ perfluoroalkyl group; and A represents —COOM or —$SO_3M$, or functional group which is convertible into —COOM or —$SO_3M$ by a hydrolysis or a neutralization such as —CN, —COF, —$COOR_1$, —$SO_2F$ and —$CONR_2R_3$ or —$SO_2NR_2R_3$ and M represents hydrogen or an alkali metal atom; $R_1$ represents a $C_1$–$C_{10}$ alkyl group; $R_2$ and $R_3$ represent H or a $C_1$–$C_{10}$ alkyl group.

It is preferable to use a fluorinated ion exchange membrane having an ion exchange group content of 0.5 to 4.0 miliequivalence/gram dry polymer especially 0.8 to 2.0 miliequivalent/gram dry polymer which is made of said copolymer.

In the ion exchange membrane of a copolymer having the units (M) and (N), the ratio of the units (N) is preferably in a range of 1 to 40 mol % preferably 3 to 25 mol %.

The ion exchange membrane used in this invention is not limited to be made of only one kind of the polymer or the polymer having only one kind of the ion exchange group. It is possible to use a laminated membrane made of two kinds of the polymers having lower ion exchange capacity in the cathode side, or an exchange membrane having a weak acidic ion exchange group such as carboxylic acid group in the cathode side and a strong acidic ion exchange group such as sulfonic acid group in the anode side.

The ion exchange membranes used in the present invention can be fabricated by various conventional methods and they can preferably be reinforced by a fabric such as a woven fabric or a net, a non-woven fabric or a porous film made of a fluorinated polymer such as polytetrafluoroethylene or a net or perforated plate made of a metal.

The thickness of the membrane is preferably 50 to 1000 microns especially 50 to 400 microns, further especially 100 to 500μ.

The porous non-electrode layer is formed on the anode side, the cathode side or both sides of the ion exchange membrane by bonding to the ion exchange membrane in a suitable manner which does not decompose ion exchange groups, preferably, in a form of an acid or ester in the case of carboxylic acid groups or in a form of —$SO_2F$ in the case of the sulfonic acid group.

In the electrolytic cell of the present invention, various electrodes can be used, for example, foraminous electrodes having openings such as a porous plate, a screen, a punched metal or an expanded metal are preferably used. The electrode having openings is preferably a punched metal with holes having a ratio of opening area of 30 to 90% or an expanded metal with openings of a major length of 1.0 to 10 mm and a minor length of 0.5 to 10 mm, a width of a mesh of 0.1 to 1.3 mm and a ratio of opening area of 30 to 90%.

A plurality of plate electrodes can be used in layers. In the case of a plurality of electrodes having different opening area being used in layers, the electrode having smaller opening area is placed close to the membrane.

The anode is usually made of a platinum group metal, a conductive platinum group metal oxide or a conductive reduced oxide thereof.

The cathode is usually a platinum group metal, a conductive platinum group metal oxide or an iron group metal.

The platinum group metal can be Pt, Rh, Ru, Pd or Ir. The iron group metal is iron, cobelt, nickel, Raney nickel, stabilized Raney nickel, stainless steel, a stainless steel treated by etching with a base (U.S. Pat. No. 4,255,247), Raney nickel plated cathode (U.S. Pat. Nos. 4,170,536 and 4,116,804), or a nickel rhodanate plated cathode (U.S. Pat. Nos. 4,190,514 and 4,190,516).

When the electrode having openings is used, the electrode can be made of the materials for the anode or the cathode by itself. When the platinum metal or the conductive platinum metal oxide is used, it is preferable to coat such material on an expanded metal made of a valve metal, such as titanium or tantalum.

When the electrodes are placed in the electrolytic cell of the present invention, it is preferable to contact the electrode with the porous non-electrode layer so as to reduce the cell voltage. The electrode, however, can be placed leaving a proper space from the porous non-electrode layer. When the electrodes are placed in contact with the porous non-electrode layer, it is preferable to contact them under a low pressure e.g. 0 to 2.0 kg/cm$^2$, rather than high pressure.

When the porous non-electrode layer is formed on only one surface of the membrane, the electrode at the other side of the ion exchange membrane having no porous layer can be placed in contact with the membrane or with a space from the membrane.

The electrolytic cell used in the present invention can be monopolar or bipolar type in the above-mentioned structure. The electrolytic cell used for the electrolysis of an aqueous solution of an alkali metal chloride, is made of a material being resistant to the aqueous solution of the alkali metal chloride and chlorine such as valve metal like titanium in the anode compartment and is made of a material being resistant to an alkali metal hydroxide and hydrogen such as iron, stainless steel or nickel in the cathode compartment.

In the present invention, the process condition for the electrolysis of an aqueous solution of an alkali metal chloride can be the known condition as disclosed in the above-mentioned Japanese Laid-Open Patent Application No. 112398/79.

For example, an aqueous solution of an alkali metal chloride (2.5 to 5.0 Normal) is fed into the anode compartment, and water or a dilute solution of an alkali metal hydroxide is fed into the cathode compartment and the electrolysis is preferably carried out at 80° to 120° C. and at a current density of 10 to 100 A/dcm$^2$.

In this case, heavy metal ions such as calcium or magnesium ions in the aqueous alkali metal chloride solution tend to lead to degradation of the ion exchange membrane, and it is desirable to minimize such ions as far as possible. Further, in order to prevent the generation of oxygen at the anode, an acid such as hydrochloric acid may be added to the aqueous alkali metal solution.

Although the electrolytic cell for the electrolysis of an alkali metal chloride has been illustrated, the electrolytic cell of the present invention can likewise be used for the electrolysis of water, a halogen acid (HCl, HBr) an alkali metal carbonate, etc.

The present invention will be further illustrated by certain examples which are provided for purposes of illustration only and are not intended to limit the present invention.

EXAMPLE 1

A mixture comprising 10 parts of $\alpha$-silicon carbide powder having an average particle size of 2$\mu$, one part of modified PTFE particles having a particle size of at most 0.5$\mu$ and composed of polytetrafluoroethylene particles coated with a copolymer of tetrafluoroethylene with $CF_2{=}CFO(CF_2)_3COOCH_3$, 0.3 part of methyl cellulose (a 2% aqueous solution having a viscosity of 1500 cps), 14 parts of water, 0.2 part of cyclohexanol and 0.1 part of cyclohexanone, was kneaded to obtain a paste.

The paste was screen-printed on the cathode side surface of an ion exchange membrane composed of a copolymer of polytetrafluoroethylene with $CF_2{=}CFO(CF_2)_3COOCH_3$ and having an ion exchange capacity of 1.44 meq/g dry resin and a thickness of 280$\mu$, with use of an printing device comprising a Tetoron screen having 200 mesh and a thickness of 75$\mu$ and a screen mask provided thereunder and having a thickness of 30$\mu$, and a polyurethane squeegee. The printed layer formed on the cathode side surface of the ion exchange membrane was dried in the air.

Then, rutile-type $TiO_2$ powder having an average particle size of 5$\mu$ was screen-printed on the anode side surface of the ion exchange membrane in the same manner as above, and then dried in the air. Thereafter, the titanium oxide powder and the silicon carbide powder were pressed onto the ion exchange membrane at a temperature of 140° C. under pressure of 30 kg/cm$^2$. The amounts of the titanium oxide powder and the silicon carbide thereby attached to the surface of the membrane were 1.1 mg/cm$^2$ and 0.8 mg/cm$^2$, respectively. Each thickness of the porous layer made of titanium oxide and silicon carbide was 7$\mu$ and 8$\mu$, respectively. Then, the ion exchange membrane was dipped in an aqueous solution containing 25% by weight of sodium hydroxide at 90° C. for 16 hours for the hydrolysis of the membrane.

EXAMPLES 2 to 8

Cation exchange membranes having a porous layer on their surface were prepared in the same manner as in Example 1 except that the modified PTFE was used to prepare the paste of Example 1 and the composition was modified by using the materials, particle sizes and amounts of deposition as shown in Table 1.

The particles were prepared from commercial products by pulverizing and classifying them, as the case required, to have the particle sizes as shown in Table 1. In Example 8, it was observed by the microscopic observation that particles or groups of particles in the porous layer were deposited on the surface of the membrane with a space from one another.

TABLE 1

| Example No. | Materials, (Particle sizes), Amounts of deposition | | | |
|---|---|---|---|---|
| | Anode side | Thickness (μ) | Cathode side | Thickness (μ) |
| 2 | $Fe_2O_3$ (3μ) 0.3 mg/cm$^2$ | 7 | $B_4C$ (2μ) 0.9 mg/cm$^2$ | 10 |
| 3 | $SnO_2$ (2μ) 1.0 mg/cm$^2$ | 4 | $Si_3N_4$ (2μ) 1.1 mg/cm$^2$ | 9 |
| 4 | $ZrO_2$ (5μ) 1.0 mg/cm$^2$ | 6 | α-SiC (5μ) 1.1 mg/cm$^2$ | 10 |
| 5 | $Nb_2O_5$ (5μ) 1.0 mg/cm$^2$ | 6 | BN (3μ) 0.8 mg/cm$^2$ | 9 |
| 6 | $TiO_2$ (5μ) 1.0 mg/cm$^2$ | 6 | $MoSi_2$ (7μ) 0.8 mg/cm$^2$ | 10 |
| 7 | $MnO_2$ (7μ) 1.2 mg/cm$^2$ | 10 | AlN (5μ) 0.9 mg/cm$^2$ | 8 |
| 8 | $TiO_2$ (2–10μ) 0.01 mg/cm$^2$ | 10 | β-SiC (5–20μ) 0.01 mg/cm$^2$ | 15 |

EXAMPLE 9

A suspension containing 10 g. of μ-silicon carbide having an average particle size of 5μ in 100 ml. of water, was sprayed on both sides of the same ion exchange membrane as used in Example 1 which was placed on a hot plate at 140° C., with the use of a spray gun. The spraying rate was controlled so that the water in the sprayed suspension was dried up within 15 seconds after the spraying. Then, the porous layer formed by the spraying was pressed onto the ion exchange membrane at a temperature of 140° C. under pressure of 30 kg/cm$^2$. On both sides of the ion exchange membrane, β-silicon carbide was deposited in an amount of 0.8 mg/cm$^2$. The thickness of the porous layers made of β-silicon carbide was 9μ. Thereafter, the ion exchange membrane was dipped in an aqueous solution containing 25% by weight of sodium hydroxide at a temperature of 90° C. for the hydrolysis of the membrane.

EXAMPLE 10

An ion exchange membrane having 1.1 mg/cm$^2$ of titanium oxide powder and 0.8 mg/cm$^2$ of silicon carbide powder deposited on the anode side and the cathode side, respectively, of the membrane, was prepared in the same manner as in Example 1 except that as the ion exchange membrane, a cation exchange membrane (the ion exchange capacity: 0.87 meq/g dry resin, the thickness: 300μ) composed of a copolymer of $CF_2{=}CF_2$ with $CF_2{=}CFOCF_2CF(CF_3)OCF_2CF_2SO_2F$ was used. Each thickness of the porous layer made of titanium oxide and silicon carbide was 7μ and 8μ, respectively.

Now, the electrolytic characteristics of the ion exchange membranes according to the present invention, as actually used, will be described with reference to Working Examples.

Test No. 1

An anode composed of an expanded metal (the minor length: 2.5 mm, the major length: 5 mm) of titanium coated with a solid solution of ruthenium oxide, iridium oxide and titanium oxide and having a low chlorine overvoltage, was pressed against the anode side of an ion exchange membrane to contact therewith, and a cathode prepared by subjecting an expanded metal (the minor length: 2.5 mm, the major length: 5 mm) of SUS 304 to etching treatment in an aqueous solution containing 52% by weight of sodium hydroxide at 150° C. for 52 hours, to have a low hydrogen-over voltage, was pressed against the cathode side of the ion exchange membrane to contact therewith. Electrolysis was conducted at 90° C. under 40 A/dm$^2$ while supplying a 5N sodium chloride aqueous solution to the anode compartment and water to the cathode compartment and maintaining the sodium chloride concentration in the anode compartment to be 4N and the sodium hydroxide concentration in the cathode compartment to be 35% by weight. The results thereby obtained are shown in Table 2.

In Tests, the ion exchange membranes having a porous layer are identified by the numbers of Examples.

TABLE 2

| Nos. | Membranes (Nos of Examples) | Cell voltages (V) | Current efficiencies (%) |
|---|---|---|---|
| 1 | 1 | 3.25 | 92 |
| 2 | 2 | 3.23 | 92.5 |
| 3 | 3 | 3.22 | 91 |
| 4 | 4 | 3.24 | 92.5 |
| 5 | 5 | 3.20 | 92 |
| 6 | 6 | 3.19 | 92 |
| 7 | 7 | 3.25 | 92.5 |
| 8 | 8 | 3.31 | 93 |
| 9 | 9 | 3.23 | 92 |
| 10 | 10 | 3.26 | 85 |

Test No. 2

Electrolysis was conducted in the same manner as in Test No. 1 except that the anode and the cathode were respectively spaced from the ion exchange membrane for 1.0 mm, instead of contacting them to the membrane. The results thereby obtained are shown in Table 3.

TABLE 3

| Nos. | Membranes (Nos. of Examples) | Cell voltages (V) | Current efficiencies (%) |
|---|---|---|---|
| 11 | 1 | 3.30 | 93 |
| 12 | 3 | 3.26 | 92.5 |
| 13 | 5 | 3.25 | 93.5 |
| 14 | 7 | 3.29 | 94 |

Test No. 3

Prior to the use, the ion exchange membrane was hydrolyzed in an aqueous solution containing 20% by weight of potassium hydroxide instead of the aqueous solution containing 25% by weight of sodium hydroxide. The electrodes are used in Test No. 1 were pressed against the ion exchange membrane having a porous layer, to contact therewith. Electrolysis was conducted at a temperature of 90° C. under 40 A/dm$^2$ while supplying a 3.5N potassium chloride aqueous solution to the anode compartment and water to the cathode compartment and maintaining the potassium chloride concentration in the anode compartment to be 2.5N and the potassium hyroxide concentration in the cathode compartment to be 35% by weight. The results thereby obtained are shown in Table 4.

TABLE 4

| Nos. | Membranes (Nos. of Examples) | Cell voltages (V) | Current efficiencies (%) |
|---|---|---|---|
| 15 | 2 | 3.19 | 95.0 |
| 16 | 4 | 3.20 | 96.0 |

Test No. 4

An expanded metal (the minor length: 2.5 mm, the major length: 5 mm) of nickel was pressed against the anode side of the ion exchange membrane to contact therewith, and the cathode as used in Test No. 1 was pressed against the cathode side of the membrane to contact therewith. Electrolysis of water was conducted at a temperature of 90° C. under 50 A/dm$^2$ while supplying an aqueous solution containing 30% by weight of potassium hydroxide to the anode compartment and water to the cathode compartment and maintaining the potassium hydroxide concentrations in the anode and cathode compartments to be 20%. The results thereby obtained are shown in Table 5.

TABLE 5

| No. | Membrane (No. of Example) | Cell voltage (V) |
|---|---|---|
| 17 | 10 | 2.30 |

COMPARATIVE EXAMPLE

Electrolysis was conducted in the same manner and conditions as in Test No. 1 except that the ion exchange membrane as in Example 1 having no porous layer was used. The results thereby obtained are shown below.

| Cell voltage (V) | Current efficiency (%) |
|---|---|
| 3.61 | 93.5 |

We claim:

1. In an ion exchange membrane electrolytic cell which comprises an anode, a cathode, an anode compartment and a cathode compartment partitioned by an ion exchange membrane, the improvement comprising:
   the surface of said ion exchange membrane on the cathode side of said cell having bonded thereto a gas and liquid permeable porous layer composed of non-oxide ceramic particles, said particle layer not functioning as an electrode of said cell.

2. The electrolytic cell of claim 1, wherein the non-oxide ceramic is silicon carbide, boron carbide, silicon nitride, boron nitride or molybdenum silicide.

3. The electrolytic cell of claim 1, wherein the gas and liquid permeable porous layer has a porosity of 10–99% and a thickness of 0.01 to 300.

4. The electrolytic cell of claim 1, wherein the non-oxide ceramic particles are bonded to the surface of the membrane in an amount of 0.001 to 50 mg/cm$^2$.

5. The electrolytic cell of claim 1, wherein the non-oxide ceramic particles are bonded to the surface of the membrane with a binder composed of a fluorinated polymer.

6. The electrolytic cell of claim 1, wherein the ion exchange membrane is a fluorine-containing ion exchange membrane having sulfonic acid groups, carboxylic acid groups, or phosphoric acid groups.

7. The electrolytic cell of claim 1, wherein the anode or cathode or both of said cell is positioned in contact with the ion exchange membrane.

8. The electrolytic cell of claim 1, wherein the cathode is positioned in contact with the ion exchange membrane.

9. The electrolytic cell of claim 1, wherein the anode and the cathode are an expanded metal with openings having a major length of 1.0 to 10 mm and a minor length of 0.5 to 10 mm, said openings constituting 30–90% of the area of the electrode.

10. The elctrolytic cell of claim 1, wherein the anode and the cathode are each a metal piece having holes punched therein, the openings in said metal pieces constituting 30–90% of the area of each electrode.

11. The electrolytic cell of claim 1, wherein said cell is provided with a plurality of foraminous electrodes of different surface area openings, with the electrodes of open surface area being positioned closer to the membrane.

12. The electrolytic cell of claim 1 wherein said cell is employed in the electrolysis of water, or the electrolysis of an aqueous solution of an acid, a base, an alkali metal halide or an alkali metal carbonate.

13. In an ion exchange membrane electrolytic cell which comprises an anode, a cathode, an anode compartment and a cathode compartment partitioned by an ion exchange membrane, the improvement comprising:
   the surface of said ion exchange membrane on the cathode side of said cell having bonded thereto a gas and liquid permeable porous layer composed of non-oxide ceramic particles, said particle layer not functioning as an electrode of said cell and the voltage characteristics of said cell as a function of varying pressure on said membrane being essentially constant.

* * * * *